US011217969B2

(12) United States Patent
Kim et al.

(10) Patent No.: US 11,217,969 B2
(45) Date of Patent: Jan. 4, 2022

(54) SPACE PLASMA GENERATOR FOR IONOSPHERIC CONTROL

(71) Applicant: ENIG ASSOCIATES, INC., Bethesda, MD (US)

(72) Inventors: Yil-Bong Kim, Silver Spring, MD (US); Eric N. Enig, Bethesda, MD (US); Daniel N. Bentz, Derwood, MD (US); Michael J. Barnard, Columbia, MD (US)

(73) Assignee: ENIG ASSOCIATES, INC., Rockville, MD (US)

( * ) Notice: Subject to any disclaimer, the term of this patent is extended or adjusted under 35 U.S.C. 154(b) by 51 days.

(21) Appl. No.: 15/760,331

(22) PCT Filed: Sep. 15, 2016

(86) PCT No.: PCT/US2016/051841
§ 371 (c)(1),
(2) Date: Mar. 15, 2018

(87) PCT Pub. No.: WO2017/083005
PCT Pub. Date: May 18, 2017

(65) Prior Publication Data

US 2018/0248341 A1 Aug. 30, 2018

Related U.S. Application Data

(60) Provisional application No. 62/218,698, filed on Sep. 15, 2015.

(51) Int. Cl.

| | |
|---|---|
| ***H05H 1/24*** | (2006.01) |
| ***H01T 23/00*** | (2006.01) |
| ***F42B 12/50*** | (2006.01) |
| ***F42B 12/46*** | (2006.01) |
| ***F42B 12/36*** | (2006.01) |

(52) U.S. Cl.
CPC ..... *H01T 23/00* (2013.01); *F42B 12/36* (2013.01); *F42B 12/46* (2013.01); *F42B 12/50* (2013.01); *H05H 1/24* (2013.01); *H05H 1/2406* (2013.01); *H05H 1/245* (2021.05)

(58) Field of Classification Search
CPC ..... H01T 23/00; H05H 1/24; H05H 1/2406; H05H 2001/245; F42B 12/36; F42B 12/46
See application file for complete search history.

(56) References Cited

U.S. PATENT DOCUMENTS 5,132,597 A * 7/1992 Goebel ..... H01J 17/063 313/161
5,241,243 A * 8/1993 Cirri ..... H05H 1/48 313/231.31
5,693,376 A * 12/1997 Fetherston ..... C23C 14/046 204/192.12
7,486,758 B1 * 2/2009 Turchi ..... G21B 1/00 315/111.21

(Continued)

*Primary Examiner* — Amy Cohen Johnson
*Assistant Examiner* — Jianzi Chen
(74) *Attorney, Agent, or Firm* — Browdy and Neimark, P.L.L.C.

(57) ABSTRACT

A plasma generator composed of a body of electrically conductive, ionizable material connected to conduct a current pulse and to be converted into a plasma that occupies a large volume in the ionosphere. A plasma generating system composed of a source of a high intensity current pulse and the plasma generator.

14 Claims, 7 Drawing Sheets

(56) References Cited

U.S. PATENT DOCUMENTS

2008/0179286 A1* 7/2008 Murokh ..... A61L 2/14
216/67
2015/0091442 A1* 4/2015 Mai ..... H01J 37/32669
315/111.41

* cited by examiner

SPACE PLASMA GENERATOR FOR IONOSPHERIC CONTROL

BACKGROUND OF THE INVENTION

The present invention relates to a space plasma generator for producing a large area plasma region in the ionosphere.

Flux compression generators for producing a high current are already known in the art. An example thereof is disclosed in U.S. Pat. No. 4,370,576, Foster, Jr., issued on Jan. 25, 1983, and the entirety of which is incorporated herein by reference.

It is known that extremely high magnetic fields can be obtained using high explosives as an energy source in flux compression generators. In such a generator, an explosive detonation compresses an established low-level magnetic field into a very high density field, with an associated high electrical current flow. Typically, a low-level magnetic field is established within a confined space or cavity and acted upon by the force of explosive detonation to collapse that space to a relatively small volume in which the magnetic field is trapped and compressed. Since the trapped magnetic field exerts magnetic pressure, the explosive does work against that pressure and in the process transfers its chemical energy into electrical energy within the FCG electrical circuit. The FCG principles apply to various geometries where the size of the space, or cavity, is reduced. To date, mostly cylindrical geometries have been explored.

There are two types of cylindrical FCGs, namely, coaxial and helical.

A coaxial generator consists of a central cavity containing a centrally located high explosive filled cylindrical shell acting as a conducting armature, a cavity between the armature and an outer metallic shell that acts as a conducting stator, and conducting end caps to complete the electrical circuit and provide confinement of the compressed magnetic field. One example of a coaxial generator that can be employed in devices according to the invention is disclosed in: J. H. Goforth, et al, "The Ranchero Explosive Pulsed Power System," 11$^{th}$ IEEE International Pulsed Power Conference, Hyatt Regency, Baltimore Md., Jun. 29-Jul. 2, 1997.

A helical generator consists of a similar armature, a stator formed from windings of wires, a cavity between the armature and stator, and end caps. Generally, an electrical load, in the form of a relatively small cavity encased in conducting metals, is attached to the output end of the FCG. One example of a helical generator that can be employed in devices according to the invention is disclosed in: A. Neuber, A. Young, M. Elsayed, J. Dickens, M. Giesselmann, M. Kristiansen, "Compact High Power Microwave Generation," *Proceedings of the Army Science Conference* (26*th*), Orlando, Fla., 1-4 Dec. 2008.

In addition, an internal arrangement within the device is structured so that an electrical "seed" current can be fed to the metal wire conductors forming the circuit of the stator, armature, end caps, and electrical load that define the cavities of the FCG and the load. The flow of current in the conductors around these cavities establishes a "seed" magnetic field within the cavities. The cavities represent inductances while the conductors have electrical resistance. In operation, upon detonation, the armature expands radially and collides with the stator. During that process, flux compression takes place because the FCG cavity width is reduced to nearly zero. To first order, the FCG output current results from the starting inductances of both cavities relative to the final inductance of the system after magnetic compression. When the FCG is completely collapsed, current gain is the ratio of the initial cavity inductance to the final inductance represented by the load.

An advantage of the helical generator with its wire wound stator is that a much higher initial inductance can be obtained per unit length, but at the expense of added complexity. In contrast, the coaxial generator has a simpler construction, but with a considerably lower initial inductance. Both generators can have electrical breakdown (arcing) since the current and voltages rise during compression unless care is taken to use insulating gas in the cavities. The helical generator can also break down if the voltage between wires rises above a threshold limit related to the insulation used between windings. Further, because of Joule heating due to resistance, the wires can only carry a limited amount of current without reaching their melting temperature. For well-designed generators of similar length, typical current gains are 10 to 12 for the coaxial types, and above 2000 for a helical wound generator. Often, coaxial generators are used with much higher seed current to get high output current since premature electrical breakdown and wire melting are not issues.

When initiation of the high explosive (HE) is started at one end of the HE column, i.e. along the length of the generator, the detonation wave travels from that end to the opposite end of the column, referred to as the output end. Armature radial motion first occurs at the initiation end with a progressive expansion from the initiation end to the output end. This sequential motion results in an armature expansion that has a conical profile with the cone becoming progressively larger until successive elements strike the stator. Thus, the armature first strikes the stator at the initiation end and subsequently strikes the stator at progressive locations until impact with the entire stator is complete at the output end. As the armature progressively fills the cavity, magnetic compression progressively takes place. The progression gives rise to a near exponential increase in current to a peak value that occurs near to total cavity collapse where the system inductance has a minimum value. Thus, for the helical generator, initial winding sections are subject to relatively low voltages and temperatures while sections toward the output end approach or exceed the voltage and temperature limits. Internal voltages, electrical breakdown, and wire melting have limited the ability to develop more efficient flux compression generators. In addition, explosive initiation techniques and quality control of fabricated parts including the end caps, stators, and armatures have a major influence on the ability to improve current outputs of FCGs.

Work with explosively driven flux compression in the United States dates back to C. M. Fowler's work published in 1960: C. M. Fowler, W. B. Garn, and R. S. Caird, "Production of Very High Magnetic Fields by Implosion," *Journal of Applied Physics,* 31(3), 1960, pp. 588-594.

Since then, both coaxial and helical generators have been designed, built, and tested. The most notable groups examining helically wound generators include Los Alamos National Laboratory in Los Alamos, N. Mex., as disclosed in: C. M. Fowler and L. L. Altgilbers, "Magnetic Flux Compression Generators: a Tutorial and Survey," *Journal of Electromagnetic Phenomenon,* 3(11), 2003, pp. 305-357, the Kurchatov Institute of Atomic Energy in Moscow, S. Kassel, "Pulsed-Power Research and Development in the USSR," R-2212-ARPA, May 1978, and Texas Tech University in Lubbock, Tex., A. Neuber, et al, supra.

Notable patents pertaining to explosively driven flux compression devices with helically wound generators include U.S. Pat. No. 4,370,576, J. S. Foster and J. R Wilson, U.S. Pat. No. 3,356,869, J. L. Hilton and M. J. Morley, and U.S. Pat. No. 5,059,839M. F. Rose et. al, all of which are incorporated herein by reference.

U.S. Pat. No. 4,370,576 details the operation of helically wound flux compression generators. J. L. Hilton's patent claims the use of complex winding patterns to enhance electrical efficiency for flux compression devices. M. F. Rose patent outlines a flux compression/transformer system for use with high impedance loads.

The cited developments, while exploratory in nature, have not resulted in efficient FCG designs. Mainly, the threshold limits have been low while some FCG's have been relatively large and heavy with low current gains. Further, applications to weaponry have not been forthcoming because of FCG low-output, large size, awkward packaging into warhead compartments within projectiles or missiles, and requirement for external power sources to produce seed current. In addition, for weaponry that deliver lethal kinetic energy, use of FCG's with dynamic loads to produce kinetic energy penetrators and multiple kinetic energy effects has not been investigated.

An FCG can act as a global current source of energy is applied through electrical conduits connecting the FCG with an electrical load. A single detonator activates the FCG. The FCG can be given a higher efficiency by combining in "unitary" fashion an initial helical section where currents are relatively low with a final coaxial section where current is high. Also, the FCG can have several helical winding sections along its length, each with varied pitch and wire size to accommodate increased currents as the armature engages successive stator sections. At the ends of each helical winding section, wires are bifurcated to allow each section to progressively cope with increasing current by splitting that current between multiple wires. This approach provides a highly efficient FCG design with increased output current.

The output of the FCG can be connected to selected loads through thin insulated channels. Upon command, the selected load can be connected to the FCG by dynamic switching.

An FCG that can be used in the practice of the present invention can include a generator explosive, an initiation scheme to ring initiate the FCG explosive, and an electronics package for producing a seed current for the FCG. The resulting flux compression generator is unified in that it utilizes components of helical and coaxial stator structures to provide additional energy.

BRIEF SUMMARY OF THE INVENTION

Artificial control of ionospheric plasma density has a large number of applications involving (i) control of trans-ionospheric radio wave paths, including control of GPS signals, (ii) Artificial Ionospheric Mirrors (AIM), (iii) Over-the-Horizon (OTH) radar and, (iv) Extremely/Very Low Frequency (ELF/VLF) communication paths.

The present invention provides a device for generating a large area plasma field, primarily in the ionosphere, by supplying an extremely high amplitude current to a body of highly ionizable material in a plasma chamber to ionize the material and allow it to spread out into a large area. The preferred manner of generating the current, because it must have a high amplitude, is to produce the current in the form of a pulse.

Preferably, the current pulse is produced by a flux compression generator (FCG) and the ionizable material is selected from materials that are conductive and that have a low heat of fusion and low ionization energy. One preferred material is lithium.

Preferably, the ionizable material is in the form of a coating or layer on an electrically insulating, preferably dielectric, substrate. The substrate is in the form of a tube that is either provided with openings in the form of slits or is completely closed. The ionizable material is provided on interior surfaces of the tube and is connected to the source of high amplitude current so that the current flows through, and ionizes, the ionizable material.

If the tube is provided with slits, the ionized material is ejected through the slits. If the tube is completely closed, the magnetic and thermal pressure generated by the ionization event cause the tube to explode, thus causing the ionized material to be ejected.

The present invention uses the electrical ionization of solid metallic liners with low heat of vaporization and low ionization energy.

Space plasma generators according to the invention could be used to smooth out ionospheric disturbances to assure reliable communications and navigation in theater, or to provide novel capabilities for RF systems. Advanced plasma generators could also replace civilian systems used as tracers in various upper atmospheric research efforts. Desired plasma generators should be able to produce at least $10^{25}$ ion-electron pairs and fit within a 3U to 12U CubeSat form factor to be deployed via either a sounding rocket or an air-launched missile (e.g., DARPA ALASA) to an ionosphere altitude.

Figure 1:
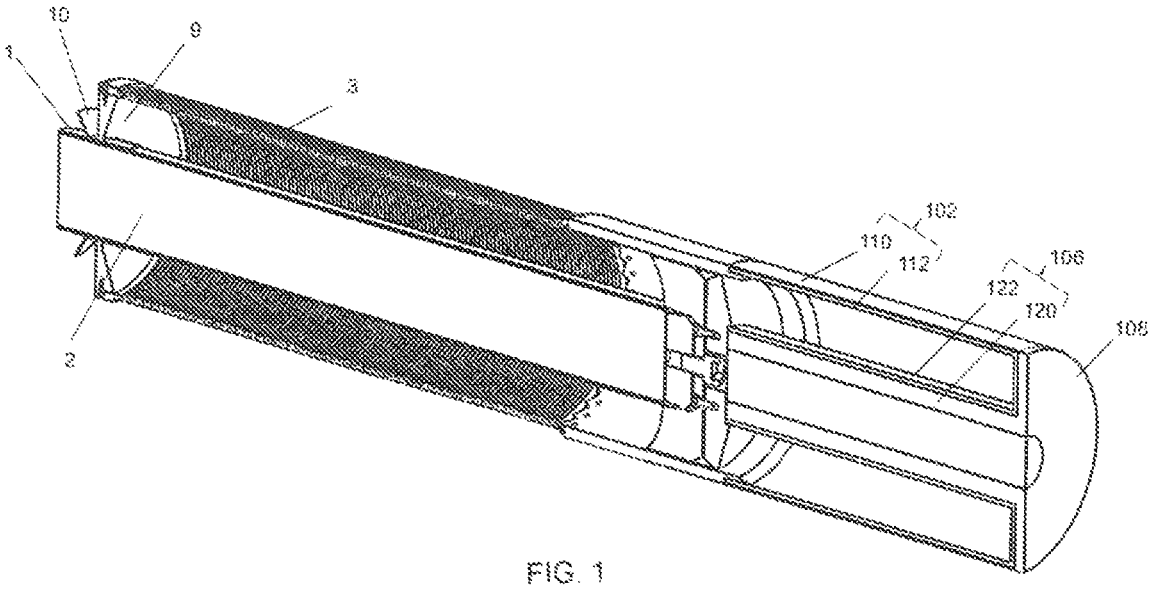
FIG. 1 is a longitudinal sectional perspective view of a first embodiment of the invention.
Figure 2:
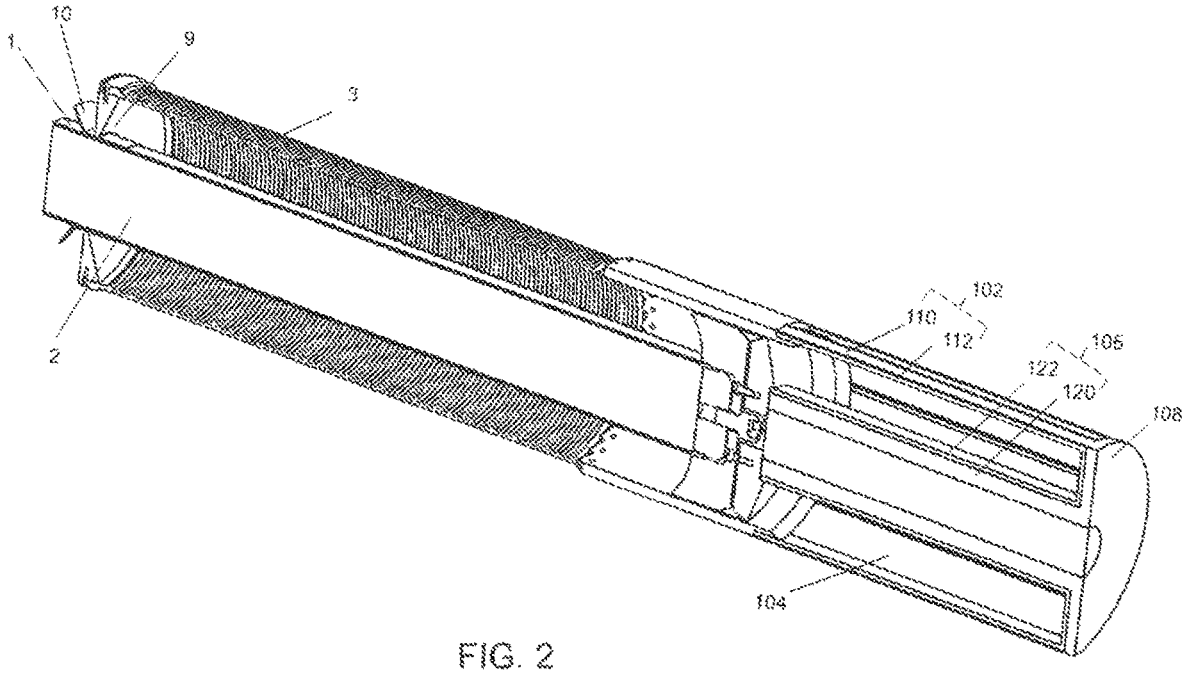
FIG. 2 is a longitudinal sectional perspective view of a second embodiment of the invention.

Certain reference numerals appearing in FIGS. 1 and 2 are described with reference to FIGS. 5-7.

DETAILED DESCRIPTION OF THE INVENTION

A space plasma generator according to the invention utilizes an electrical ionization method, preferably using an explosively-driven flux compression generator (FCG) as a compact disposable power source to create enough plasma in the ionosphere for the above noted purposes. Physically connected to the FCG is a load chamber, or plasma chamber, which has been plated, or coated, with a low ionization energy alkali metal, such as lithium. The objective of this system is to create electrically ionized plasma in space.

Two different chamber embodiments will be disclosed: (i) Open chamber, consisting of axial slits; and (ii) closed chamber, with no slits. The open chamber embodiments, while similar to the wire array load used in standard Z-pinch devices, differs greatly from these systems.

An example of the open chamber embodiment is shown in FIG. 2, in which a portion of the generator has been cut away. This embodiment is also shown in cross-sectional views in FIGS. 5 and 6. The basic idea is that, while the FCG current is rising and decaying, during its operation, the plasma is generated and released by radial transport or JXB ejection in the form of a thin disk through openings in the outer shell. Plasma and magnetic flux are released during the FCG operation to relieve high plasma and magnetic pressure build-up in the chamber.

This system can create up to 100 km radius plasma disk almost instantly in upper ionosphere for desirable RF effects.

Plasma-forming materials for a plasma generator according to the invention preferably include highly ionizable, conductive plasma-forming metallic materials, such as alkali metals, which have the lowest first ionization energy (~5 eV). For example, the amounts of total energy required to melt, vaporize, and singly-ionize 17 moles (to generate $10^{25}$ e-i pairs) of Lithium (Li), Sodium (Na), and Potassium (K) are 11.7 MJ, 10.5 MJ, and 8.8 MJ, respectively. These numbers include (i) molar heat capacity, (ii) heat of fusion, (iii) heat of vaporization, and (iv) $1^{st}$ ionization energy, when 17 moles of solid fuel goes through multiple phase transitions from a room temperature solid state to a first ionized plasma state. These alkali metals are reasonably good conductors, so they can be used as electrical loads connected to an FCG. For 17 moles, the mass of these loads are 118 g, 391 g, and 663 g for Li, Na, and K, respectively. Based on energy estimations, it appears feasible to generate 17 moles of plasma from a 3U to 12U CubeSat form factor to include FCG, load, and its small supporting electrical system.

Li is presently a preferred example of a plasma-forming material mainly due to its light weight and conductivity characteristics. Analysis presented here, however, can be applied to any multi-phase conductive material, composite hybrid materials, and even alloys.

Plasma Generating Liner Load Phase Transition and Liner Geometry. The basic mechanisms of electromagnetic energy coupling to plasma generating metallic loads are Joule heating and JXB forces. As Joule heating rapidly heats a solid metallic load, its resistance can change two orders of magnitude during multiple phase transitions.

Alkali metals should show similar conductivity behavior to Al.

The FCG load geometry must be chosen to generate the maximum amount of plasma. Two of the many different structures that may be used are: (i) an open chamber to emit plasma during FCG operation and (ii) a closed chamber to expel plasma at the end of an FCG operation.

The second scheme is a closed chamber design that converts metallic solid fuels into a dense plasma and, then at the end of FCG operation, the closed chamber expels dense plasma either by reaching critical temperature to disconnect load circuit, or by explosive opening switch to eliminate confining magnetic field.

To model the physics of the plasma generation device, use was made of the ALEGRA-MHD code written by Sandia National Laboratories. ALEGRA-MHD is an Arbitrary Lagrangian-Eulerian (ALE) multi-material and multi-phase, finite element code that emphasizes (i) magnetohydrodynamics, (ii) large deformations, (iii) multi-phase, and (iv) strong shock physics.

A critical capability for simulating dense plasma systems is the modeling of the electrical conductivity of material in the warm dense matter regime. This is the regime where the material properties are neither that of a solid at room temperature, nor a hot ionized plasma. Rather, its state is near the metal-insulator transition, where the electrical conductivity is both poorly characterized and highly sensitive to the material state. This is the situation in the dynamical plasma-generating chamber during operation.

In addition to handling the electrical conductivity accurately, numerical modeling for multi-phase transition loads must appropriately handle the constitutive response for materials whose phase must traverse from a solid state to vaporized metal and ionized plasma.

Closed Chamber Case. FIG. 1. shows a proposed FCG and plasma chamber load in 3D. Current flows through Anode, exploding fuse and cathode axially within dynamic skin depth determined by local phase of the material. Self-contained integrated system can fit in a 3U-12U CubeS at form factor.

The closed chamber design is shown in FIG. 1. The proposed system can be envisioned to have an FCG-Li plasma chamber load. FIG. 1 shows a notional CAD drawing of physical components of the proposed device. The cylindrical section on the left is the FCG, and the section on the right is a coaxial Li plasma chamber. The self-contained integrated system can fit in a 3U-12U CubeSat form factor. The notional operation scenario is as follows:

1) A small seed current (~kA) supplies the initial seed magnetic field inside the FCG and load chamber.
1) After left end detonation of the FCG, magnetic flux is compressed and the current to the load chamber increases exponentially according to magnetic flux compression physics. The peak current reaches 10 s of MA in ~100 microsecond time scale.
2) This current melts the inner surface of Li chamber within dynamic skin depth to peel off Li solid/liquids to vaporize/ionize inside chamber.
3) Rayleigh-Taylor instabilities in the plasma will be excited in the chamber, producing turbulent behavior. When the inner chamber reaches a few electron volts, the plasma ionization rate can be determined by the Saha equilibrium. The plasma is confined by strong azimuthal magnetic field.
4) At the proper moment, the right end of the chamber behaves like an exploding fuse opening switch to terminate confining magnetic field and release plasma. JXB force and thermal effects eject the plasma.

Open Chamber Embodiment. The open chamber design differs greatly from Z-pinch devices. Our objective of the open chamber structure is not to heat the temperature of plasma to a thermonuclear condition (~20 KeV), but rather to ionize (~a few eV) large amount of plasma (over 17 moles) during a long pulse time (~20 to 100 μs). A notional drawing of this device is shown in FIG. 2. The basic idea is that, while the FCG current is rising and decaying, the plasma is released during the FCG operation by radial transport or JXB ejection to release plasma in cylindrical pattern through openings in the outer shell. We learned that this design is superior to the closed chamber design, as we do not need to use a difficult opening fuse. Moreover, plasma and magnetic flux are released during the FCG operation to relieve high plasma and magnetic pressure build-up in the chamber.

FIG. 2 shows a space plasma generator with open chamber plasma liner. An 8 slit embodiment (octagonal symmetry) in 2D infinite X-Y plane geometry with thin (5 mm) Li coated chamber is shown.

Detailed ALEGRA-MHD simulation setup for open chamber case. Initial ALEGRA-MHD simulations have been done on a 2D Cartesian mesh. These simulations look down the axis of the load, with current moving in and out of the plane of the mesh. The simulation cell's boundary conditions are set such that a single quadrant can represent the full cross section by imposing no-normal-displacement material boundary conditions and no-tangent-field magnetic boundary conditions. The azimuthal magnetic field circulates inside the mesh. By using an alumina ($Al_2O_3$) material model as a stand-in for a generic electrically insulating structural material, we construct the load as four concentric cylinders, i.e., $Al_2O_3$/Li/gap/Li/$Al_2O_3$ in this order. For the simulations considered here, the inner insulator had (i) an outer radius of 45 mm, (ii) the inner conductor has an outer radius of 50 mm, (iii) the outer conductor has an inner radius of 60 mm and outer radius of 65 mm, (iv) and the outer insulator has an outer radius of 89 mm.

The ALEGRA-MHD library has a validated SESAME Equation of State (EOS) model for Li, which contains solid, liquid, gas, and plasma phases as well as state dependent specific heat capacity and heats of fusion/vaporization/ionization. The ALEGRA-MHD library does not contain a validated elastic-plastic model for Li, so we have incorporated a crudely adjusted Johnson Cook model for now to give the material some stiffness while it is in the solid state; in the future, we will look to improve this model, but the low melting point of Li means that the effect on the results should be minor. More important is the lack of a validated Lee-More-Desjarlais (LMD) model for the conductivity of Li. For this first batch of simulations, we used a stand-in conductivity model that uses three conductivities for the solid ($1\times10^7\ \Omega^{-1}m^{-1}$), liquid ($1\times10^6\ \Omega^{-1}m^{-1}$), and gas/plasma ($1\times10^4\ \Omega^{-1}m^{-1}$) phases. The standard ALEGRA-MHD Saha ionization model is used to calculate and report the ionization state.

Figure 3:
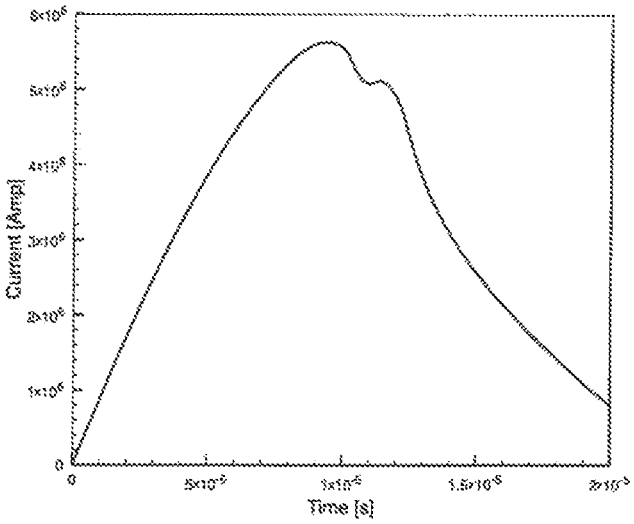
FIG. 3 shows a simulated waveform of a current pulse produced in an embodiment of the invention.

The ALEGRA-MHD simulations used an LC driving circuit with a 50 micro Farad capacitor charged to 1 MV and a 1 micro Henry inductor, which was discharged into the 2D mesh. The simulation was assumed to extend 1 m in the direction perpendicular to the mesh. This arrangement resulted in about a 5.5 MA current flowing through the quadrant modeled (corresponding to a total current about 22 MA through the full device. The current profile for the 8-slot case can be seen in FIG. 3, which is a quadrant current profile for the ALEGRA MHD simulations. As this current is only applied to one quadrant, the current for the full device would be four times what is seen here. So it is about 22 MA peak current for 20 μs duration to the whole chamber.

The simulation indicates that high temperature planes exist where the flows escaping from adjacent slots collide, corresponding to regions of low density. On average, plasma temperature seems to be between 1 and 3 eV.

A magnetic field would expand beyond the geometry of the load as the plasma escapes confinement. This seems consistent with the fact that plasma is frozen in magnetic field in highly conducting ideal MHD plasma and plasma is also moving out with JXB force.

Figure 4:
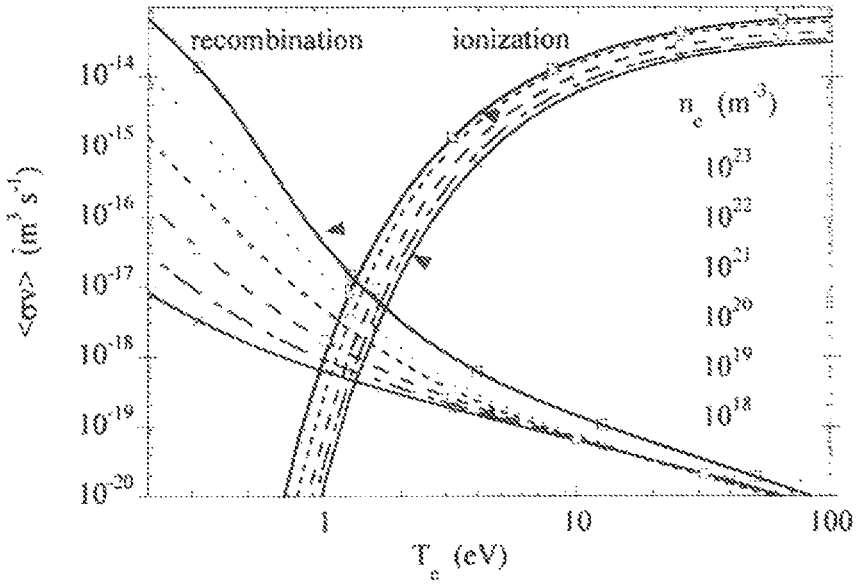
FIG. 4 shows curves of hydrogen recombination and ionization rates at different densities.

Physics of Plasma Formation and Plasma Ejection in Open Chamber Case. Based on simulation results, one of the most surprising physics results we obtained during the first sets of simulation was that the radial velocity of plasma ejection could reach up to 100 km/s. This is much higher than the 2 eV-plasma sound velocity of 5 km/s. Further analysis of the JXB force distribution on the plot, led to the conclusion that plasma accelerates to higher radial velocity even outside of the chamber since the JXB force per plasma density is actually higher outside of the chamber. The dominant force on the plasma is JXB force rather than pressure gradient force. Although it hasn't been confirmed that all Li fuel has been ionized (that is to say 100% ionization efficiency). The simulation results show that the plasma is almost fully ionized even if the temperature is well below the first ionization energy of about 5 eV. Even at 1 eV, plasma seems to be fully ionized. The ionization fraction pattern is based on the assumption that plasma is in Saha equilibrium. This observation that that ionization rate is very high even at temperatures well below the first ionization energy seems to be consistent with the fact that the hydrogen electron impact ionization rate dominates over the radiative recombination rate even at temperatures well below the first ionization energy of 13.6 eV. FIG. 4 shows the ionization rate and the recombination rate of hydrogen. Even at ⅕ of H ionization energy, plasma appears to be 99% ionized. Similarly, for Li plasma, it would be expected that the plasma is almost fully ionized even at 1 eV by similar argument.

Based on these analyses, it would be expected that the initial plasma disk jet from this open chamber device will have a form of thin washer-form shape that will expand with a radially expanding frontal speed of about 100 km/s for the time duration of 20 μs with an average internal plasma temperature of 2 eV. The plasma simulation was stopped at 20 μs. Initially, the height of the disk jet is set by the height of the open chamber height, but it will be lengthened in time due to plasma thermal spread corresponding to 2 eV internal temperatures. Depending on the release altitude of this device, the plasma annular disk jet will interact with ambient neutral gas and geomagnetic field. It is presently expected, based on test results thus far, that this plasma will evolve to a very thin disk shaped plasma whose radius is determined by radial expansion velocity and plasma mean free path at release altitude and the disk thickness is determined by plasma internal temperature. Geomagnetic field may come into play in the long-term evolution of this plasma.

Preliminary parametric studies of open chamber geometry. To start to understand what precisely determines the radial ejection speed of the disk jet, the effects of different numbers of slots have been explored (while maintaining total slot area). The main effect of increasing the slot number appears to be a reduction of the radial ejection velocity and a lowering of the internal temperature of the emitted Li disk jet.

Figure 5:
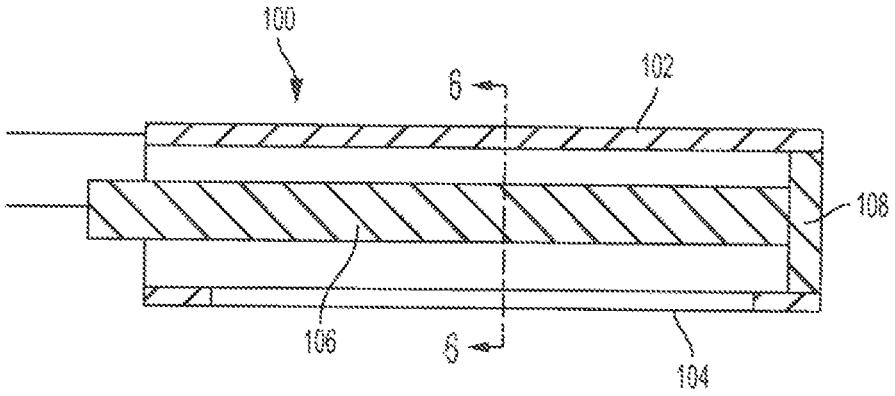
FIG. 5 is a more detailed longitudinal cross-sectional view of the second embodiment of the invention.
Figure 6:
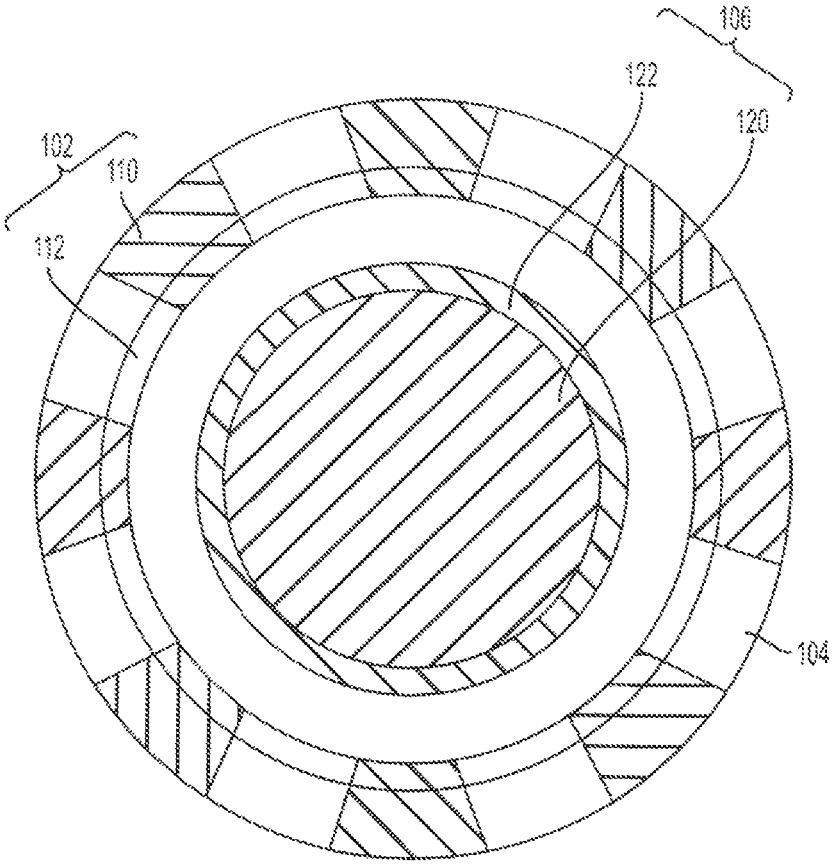
FIG. 6 is a cross-sectional view along line 6-6 of FIG. 5.

FIGS. 5 and 6 show the components of the open plasma chamber embodiments. The chamber is essentially a cylindrical tube 102 composed of an outer shell 110 of dielectric, or insulating, material and a coating, or layer, 112 of plasma forming material, such as lithium. Tube 102 is provided with an array of radially spaced, longitudinally extending slits 104 giving the chamber its open configuration.

Inside the tube is a rod 106 composed of a core 120 and a coating, or layer, 122 of the same plasma forming material. The end of the chamber is closed by a disc 108 composed of dielectric, or insulating, material and an interior coating, or layer, of the same plasma forming material. As shown in FIG. 5, the left-hand ends of tube 102 and rod 106 are connected to the terminals of the current producing section of the associated FCG. More precisely, these terminals are connected to layers 112 and 122, respectively. The layers of plasma forming material form a continuous path that extends from layer 112 through the layer on disc 108 and from the layer on disc 108 to layer 122. The current pulse from the connected FCG passes through all of the plasma forming material to vaporize and ionize it.

Figure 7:
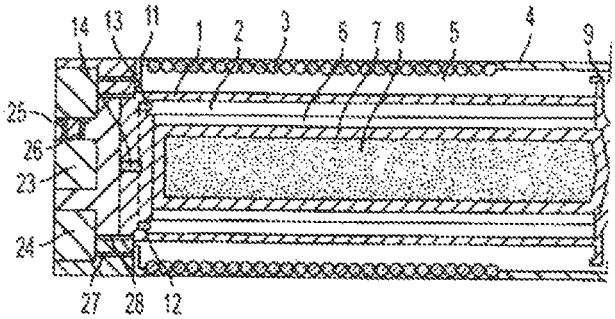
FIG. 7 is a cross-sectional view of a type of FCG that may be used in a space plasma generator according to the invention.

Another example of a FCG that can be used in the practice of the present invention is shown in FIG. 7. This FCG includes a central munition, a means to detonate the high explosives, and an electronic unit to produce starting current for the generator.

As shown, the FCG portion of the system has an armature 1, an annular shell of high explosives (HE) 2 enclosed by armature 1, a helical wound stator 3 surrounding armature 1, a stator 4 aligned with, and electrically connected to, stator 3, and a cavity 5. A buffer 6 separates high explosives 2 from the centrally located munition having a metallic casing 7 that is filled with explosive 8 having its own detonator 8*a*. The generator output end, to the right in FIG. 7 contains an armature glide rail 9. The initiation end that is opposite to the output end utilizes glide rail 11 together with a gap 12 that will act as a switch, known as a crowbar switch. Ignition of the high explosives 2 is initiated by a "ring" circular initiator 13 that is in turn ignited by ignition of a detonator 14.

Attached to the FCG output end may be a plasma generator load, as shown in FIGS. 1 and 2.

Exemplary materials for the above described components may include conducting metals such as copper or aluminum for armature 1, wires for stator 3, and coaxial section 4. Typically, munition casing 7 is made of steel while munition HE 8 is composed of TNT, PBX, TATB, or TATB derivatives. Buffer 6 is a layer of polyethylene or low density shock-absorbing material.

An electronic section is joined to the FCG at the initiation end and contains a battery 23, capacitor 24, a positive electrical connection 25 and a negative electrical connection 26 to supply current from battery 23 to capacitor 24. In operation, the thermal battery will be activated in response to activation of a point contact fuse or a proximity fuse associated with the device. After capacitor 24 is fully charged, a closing circuit switch to the FCG is turned on to supply the seed current. Thus current flows around cavity 5 and insulated channel 10 throughout the FCG/load system. The current flow establishes a "seed" current in the conductors and a seed magnetic field within cavity 5 and insulated channel 10.

After the seed current and magnetic field are established, detonator 14 is activated. And then, detonator 14 ignites, or detonates, circular initiator 13, which, in turn, effects an annular detonation of FCG high explosives 2. The annular initiation of explosives 2 creates a detonation wave that travels from the initiation end, adjacent initiator 13, to the output end of the FCG. Pressure resulting from the detonation of explosives 2 accelerates armature 1 at the initiation end firstly to a given outward radial velocity that depends on the masses of armature 1 and high explosives 2, and the specific energy of the type of FCG explosives 2 used. After the initial movement by armature 1 at the initiation end, armature 1 closes gap 12, and strikes glide rail 11. This action shorts out the capacitor 24 from the main FCG circuit that is now comprised of the metallic conductors described previously, but excludes capacitor 24 and thermal battery 23. As the detonation wave sweeps across explosives 2 from initiation end to FCG output end, armature 1 takes on a conical shape and enters cavity 5. Thus, armature 1 engages stator 3 first at the initiation end and progressively contacts additional windings of stator 3 sequentially. Windings of stator 3, after contact by armature 1, are eliminated from the active FCG electrical circuit. The volume of cavity 5 is reduced as armature 1, during its continued, axial progressive outward motion, continues to contact helical stator 3 and subsequently coaxial stator 4 until armature 1 reaches the opening between output end glide rail 9 and coaxial stator 4 delimited, or defined, by insulated channel 10. At that point, the volume, and therefore the inductance, of cavity 5 have been reduced to near zero and FCG function is complete.

In operation, the trapped magnetic field intensity and magnetic pressure acting against inside surfaces of the metallic conductors grow exponentially as armature 1 invades cavity 5. Thus, motion of armature 1 causes a progressively stronger magnetic pressure to act against armature 1. In this manner, displacement of armature 1, driven by the detonation of explosives 2, constitutes work done by explosives 2 in creating a greater magnetic field intensity and electrical current in the circuit. Essentially, chemical energy released by explosives 3 during detonation is converted to electrical energy in the form of a high current and magnetic field intensity.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A plasma generating system comprising:

a source of a high amplitude current, and a plasma chamber comprising a tube of insulating material or dielectric material and a coating or layer of plasma forming material on a surface of said tube, said coating or layer of plasma forming material being connected to said source to conduct the high amplitude current and to be converted into a plasma of the plasma forming material itself only that occupies a large volume in the ionosphere.

2. The system of claim 1, wherein the high amplitude current is a current pulse.

3. The system of claim 2, wherein said source of the high amplitude current pulse is a flux compression generator.

4. The system of claim 3, wherein the ionizable material is lithium.

5. The system of claim 2, wherein the ionizable material is lithium.

6. The system of claim 1, wherein the ionizable material is lithium.

7. The system of claim 1, wherein the ionizable material is selected from the group consisting of: an alkali metal, an alloy, and a composite with comparable conductivity to lithium and with similar phase transition energies from solid phase to plasma phase.

8. The system of claim 1, wherein the plasma chamber produces electrical ionization to melt, vaporize, and ionize a load metal in flux compression generator (FCG) explosion time scale.

9. The system of claim 1, wherein said plasma chamber has a circumference and is provided with a plurality of open slits spaced apart around the circumference to eject plasma in response to the high amplitude current.

10. A method of generating a plasma that occupies a large volume in the ionosphere, said method comprising:

providing the plasma generating system of claim 1;

actuating the source to produce a pulse of the high amplitude current; and delivering the high amplitude current pulse to the plasma forming material to convert the plasma forming material into the plasma.

11. The method of claim 10, wherein said coating or layer of plasma forming material is in a solid state.

12. The system of claim 1, wherein said plasma chamber is constructed to enable the plasma to be ejected from said chamber to occupy the large volume in the ionosphere.

13. The system of claim 1, wherein said coating or layer of plasma forming material is in a solid state.

14. The system of claim 1, wherein said plasma chamber is configured to subject the plasma forming material to a jXB force, wherein j is a vector based on the density of the high amplitude current, B is the flux density vector of a magnetic field produced by the high amplitude current, and X represents a cross function of j and B.

* * * * *